United States Patent [19]

Demetrius et al.

[11] Patent Number: 4,767,056

[45] Date of Patent: Aug. 30, 1988

[54] SPRAY GUARD

[76] Inventors: Kris Demetrius, 1909 Elsie Way No. 1, Santa Barbara, Calif. 93109; George Spector, 233 Broadway Rm. 3815, New York, N.Y. 10007

[21] Appl. No.: 40,271

[22] Filed: Apr. 20, 1987

[51] Int. Cl.[4] ..... B05B 1/28

[52] U.S. Cl. ..... 239/288; 239/290; 239/300; 239/391

[58] Field of Search ..... 239/290–300, 239/288, 288.3, 288.5, 600, 390, 391

[56] References Cited

U.S. PATENT DOCUMENTS

| | | | |
|---|---|---|---|
| 1,326,483 | 12/1919 | Doran | 239/291 |
| 1,650,686 | 11/1927 | Binks | 239/290 |
| 2,410,532 | 11/1946 | Tessier | 239/291 |
| 2,504,216 | 4/1950 | Morton | 239/296 |
| 2,814,530 | 11/1957 | Portillo | 239/296 |
| 3,857,511 | 12/1974 | Govindan | 239/296 |
| 4,218,019 | 8/1980 | Baldwin et al. | 239/290 |

*Primary Examiner*—Andres Kashnikow
*Assistant Examiner*—Karen B. Merritt

[57] ABSTRACT

A spray guard for a paint spray gun is provided that will deliver a shroud of pressurized air about a paint spray issuing from the spray nozzle to eliminate over spray of the paint and create a smoother finish to surface sprayed. Modifications are provided that include a flexible deflector with a closure that mates with holes in the spray nozzle and also include removeable spray fittings for the nozzle.

4 Claims, 2 Drawing Sheets

Fig. 1
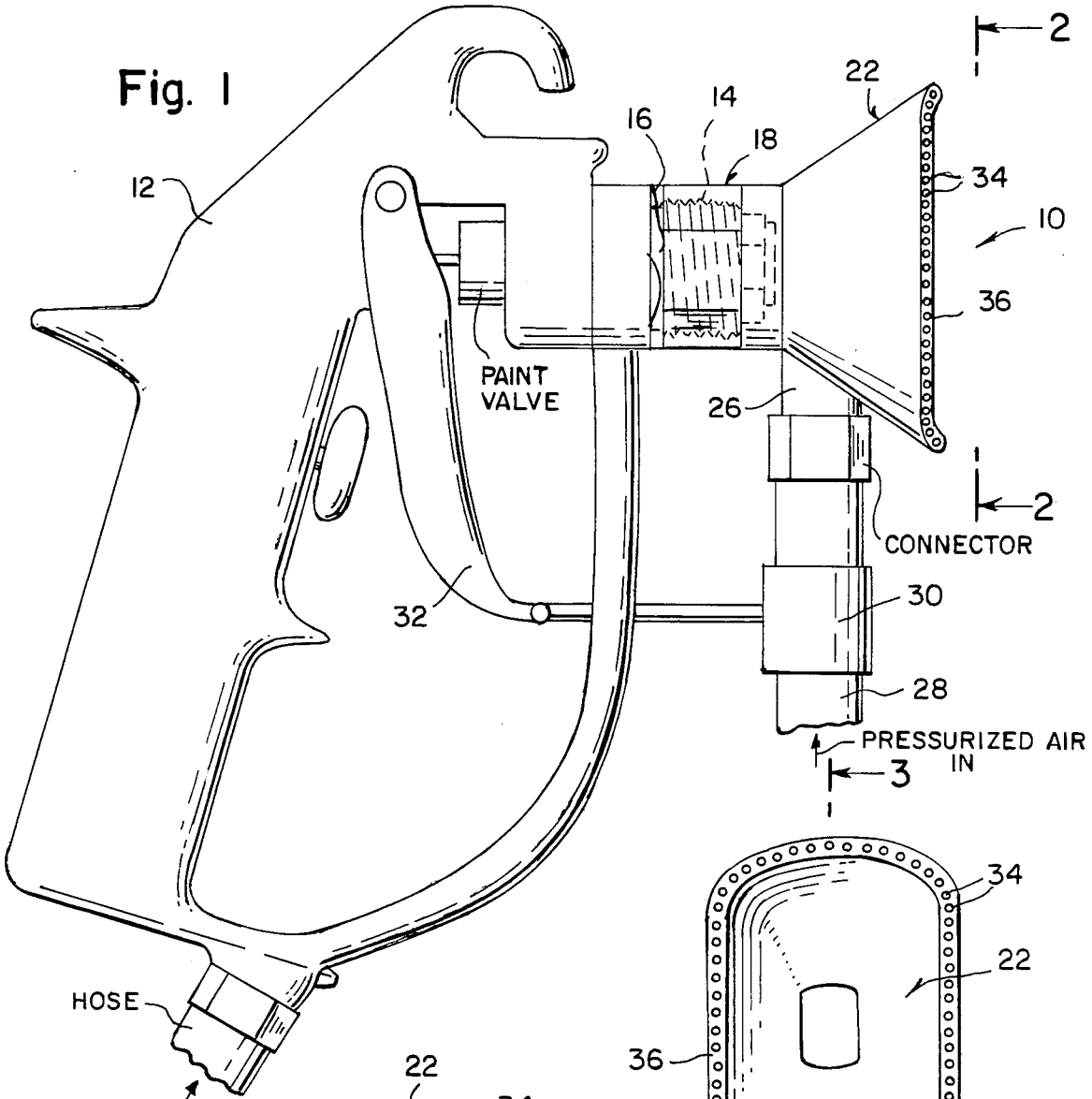
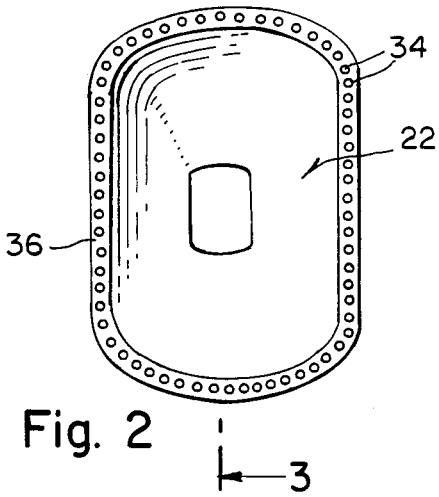
Fig. 2
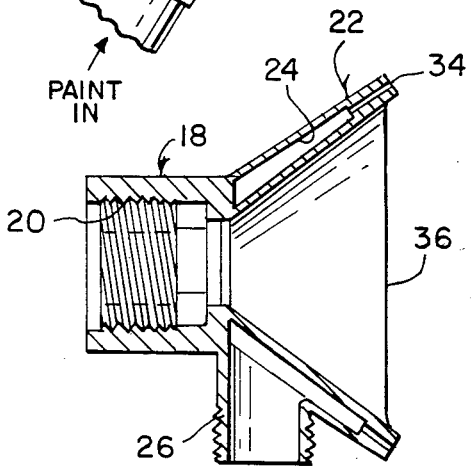
Fig. 3
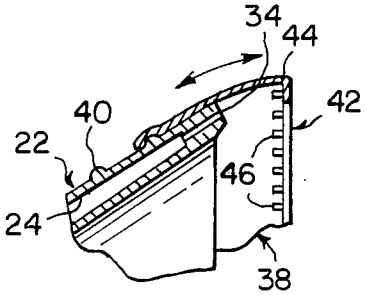
Fig. 4

SPRAY GUARD

BACKGROUND OF THE INVENTION

The instant invention relates generally to paint sprayers and more specifically it relates to a spray guard for a paint spray gun.

Numerous paint sprayers have been provided in prior art that are adapted to use air pressure to spray paint onto surfaces and establish a shroud of air around the paint spray. For example, U.S. Pat. Nos. 1,326,483; 2,410,532 and 4,218,019 all are illustrative of such prior art. While these units may be suitable for the particular purpose to which they address, they would not be as suitable for the purposes of the present invention as heretofore described.

SUMMARY OF THE INVENTION

A primary object of the present invention is to provide a spray guard for a paint spray gun that will overcome the shortcomings of the prior art devices.

Another object is to provide a spray guard for a paint spray gun that will eliminate overspray of the paint which is good for health of painter, cut down on environmental pollution and reduce minor property damage.

An additional object is to provide a spray guard for a spray gun that will create a smoother finish to surface sprayed.

A further object is to provide a spray guard that is simple and easy to use.

A still further object is to provide a spray guard that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

FIG. 1 is a side view of the invention mounted on a paint spray gun.

FIG. 2 is an end view taken along line 2—2 in FIG. 1.

FIG. 3 is a cross sectional view taken along line 3—3 in FIG. 2.

FIG. 4 is a cross sectional view of a modification with parts broken away showing an adjustable deflector with air closures thereon.

DETAILED DESCRIPTION OF THE PREFERRED EMBODIMENTS

Figure 5:
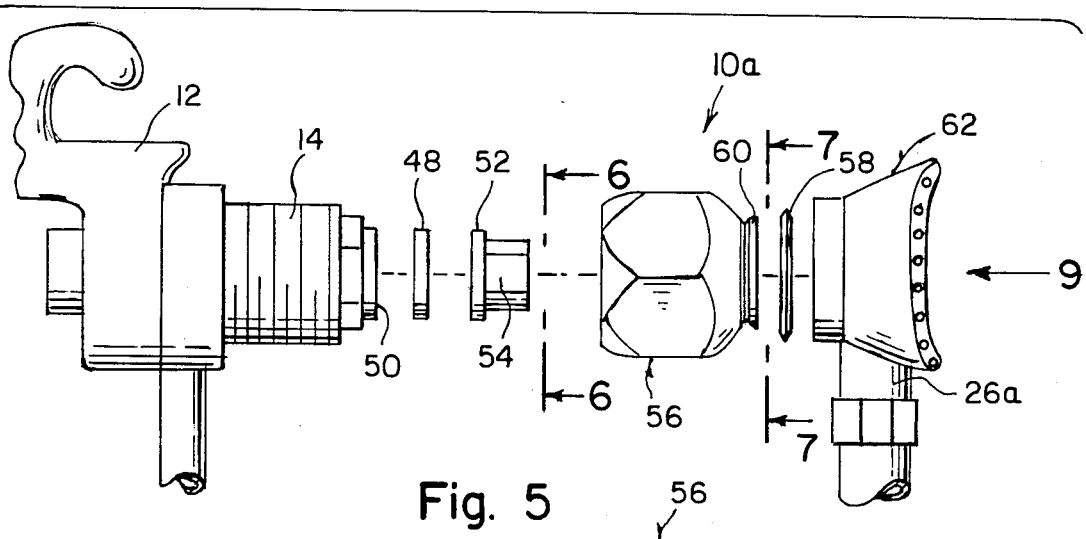
FIG. 5 is an exploded side view of another configuration with parts broken away of the spray guard assembly.
Figure 6:
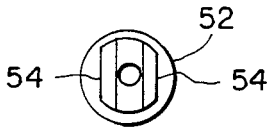
FIG. 6 is an end view of the tip taken along line 6—6 in FIG. 5.
Figure 7:
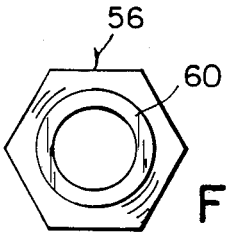
FIG. 7 is an end view of the adapter taken along line 7—7 in FIG 5.
Figure 8:
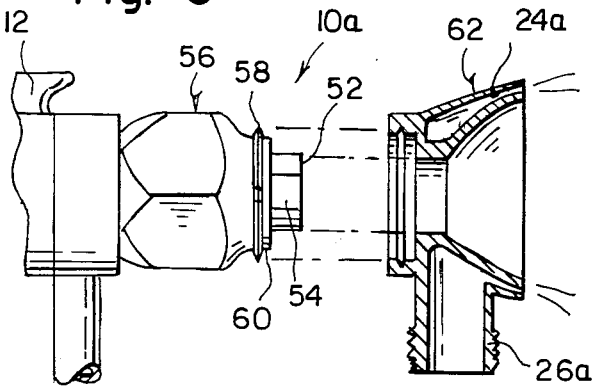
FIG. 8 is a partially exploded side view of the configuration in FIG. 5 with the funnel shaped nozzle in cross section.
Figure 9:
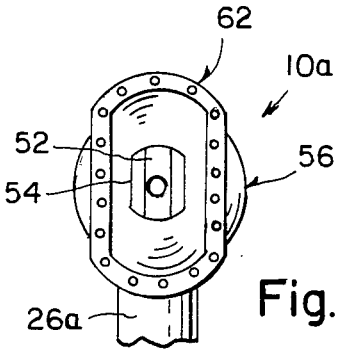
FIG. 9 is an end view taken in the direction of arrow 9 in FIG. 5.

Turning now descriptively to the drawings, in which similar reference characters denote similar elements throughout the several views, FIGS. 1 through 3 illustrate a spray guard 10 for a paint spray gun 12 that has an externally threaded spray nozzle 14. The spray guard 10 consists of a tension washer 16 received about the spray nozzle 14. An adapter 18 internally threaded at 20 is received about the spray nozzle 14 and is detachably fixed thereto against the tension washer 16. A funnel shaped nozzle 22 which is integrally part of the adapter 18 has an annular air passage 24 extending about the spray nozzle 14. An inlet port 26 is for delivering pressurized air, from a hose 28 with an air valve 30 operated by trigger 32 from the gun 12, into the air passage 24. A series of small holes 34 are spaced around outer edge 36 of the funnel shaped nozzle 22 for delivering a shroud of pressurized air about a paint spray issuing from the spray nozzle 14.

FIG. 4 shows an adjustable flexible deflector 38 slideable over the funnel shaped nozzle 22 for controlling size of the shroud of pressurized air. The funnel shaped nozzle 22 has a plurality of spaced apart external detents 40 to receive the deflector 38 in various positions thereon. An air closure 42 is provided on remote end 44 of the deflector 38 and has a series of rearwardly extending small pins 46 spaced around the remote end 44 thereof to mate with the small holes 34 in the funnel shaped nozzle 22 when the deflector 38 is at its most rearward position.

FIGS. 5 through 9 shows another configuration being a spray guard **10*a* for the paint spray gun 12 that has the externally threaded spray nozzle 14. The spray guard 10*a* consists of a plastic washer 48 placed onto end 50 of the spray nozzle 14 and tip member 52 that has flat sides 54 thereof. An adapter 56 is provided and is internally threaded to be received about the spray nozzle 14 and detachably fixed thereto over the plastic washer 48 and the tip member 52 so that the flat sides 54 of the tip member 52 extends outwardly from the adapter 56**.

A split ring 58 is rotatably fixed around outer end 60 of the adapter 56. A funnel shaped nozzle 62 is received over the split ring 58 on the adapter 56 to rotate thereabout. When the adapter 56 is fastened on the spray nozzle 14 the tip member 52 will be held upright and stationary thus holding the funnel shaped nozzle 62 upright and stationary.

The funnel shaped nozzle 62 has an annular air passage **24*a* extending about the spray nozzle 14. An inlet port 26*a* is for delivering pressurized air from the hose 28 into the air passage 24*a*. A series of small holes are spaced around the outer edge of the funnel shaped nozzle 62 for delivering a shroud of pressurized air about a paint spray issuing from the spray nozzle 14**.

Figure 10:
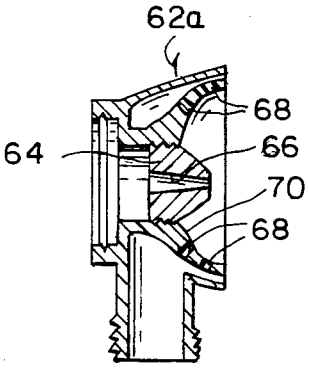
FIG. 10 is a cross sectional view of a modified funnel shaped nozzle having a fine paint spray fitting therein.

A modified funnel shaped nozzle **62*a* is shown in FIG. 10. A fine paint spray fitting 64 is threaded into the funnel shaped nozzle in front of the spray nozzle 14. The fitting 64 has a tapered front end portion 66. The funnel shaped nozzle 62*a* has a second series of small holes 68 spaced within inner surface 70 of the funnel shaped nozzle for delivering the shroud of pressurized air inwardly about a fine paint spray issuing from the tapered front end portion 66 of the fitting 64**.

Figure 11:
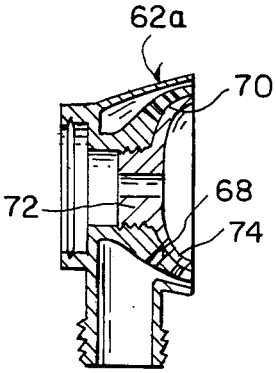
FIG. 11 is a cross sectional view similar to FIG. 10 having a regular paint spray fitting therein to block the air holes.

In FIG. 11 a regular paint spray fitting 72 can be substituted for the fine paint spray fitting 64 by being threaded into the funnel shaped nozzle 62*a* in front of the spray nozzle 14. The fitting 72 has an annular flange 74 to fit contour of the inner surface 70 of the funnel shaped nozzle 62*a* to block the second series of small holes 68.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A spray guard for a paint spray gun having an externally threaded spray nozzle, said spray guard comprising:

(a) a tension washer received about the spray nozzle;

(b) an adaptor being internally threaded to be received about the spray nozzle and detachably fixed thereto against said tension washer;

(c) a funnel shaped nozzle integrally part of said adaptor, said funnel shaped nozzle having an annular air passage extending about the spray nozzle, an inlet port for delivering pressurized air into said air passage and a series of small holes spaced around outer edge of said funnel shaped nozzle for delivering a shroud of pressurized air about a paint spray issuing from the spray nozzle;

(d) an adjustable flexible deflector slideable over said funnel shaped nozzle for controlling size of the shroud of pressurized air;

(e) said funnel shaped nozzle having a plurailty of spaced apart external detents to receive said deflector in various positions thereon; and (f) an air closure on remote end of said deflector, said closure having a series of rearwardly extending small pins spaced around the remote and thereof to mate with said small holes in said funnel shaped nozzle when said deflector is at its most rearward position.

2. A spray guard for a paint spray gun having an externally threaded spray nozzle, said spray guard comprising:

(a) a plastic washer placed onto end of said spray nozzle;

(b) a tip member having flat sides thereof;

(c) an adapter being internally threaded to be received about the spray nozzle and detachably fixed thereto over said plastic washer and said tip member so that said flat sides of said tip member extend outwardly from said adapter;

(d) a split ring rotatably fixed around outer end of said adapter; and (e) a funnel shaped nozzle received over said split ring on said adapter to rotate thereabout, when said adapter is fastened on the spray nozzle said tip member will be held upright and stationary thus holding said funnel shaped nozzle upright and stationary, said funnel shaped nozzle having an annular air passage extending about the spray nozzle, an inlet port for delivering pressurized air into said air passage and a series of small holes spaced around outer edge of said funnel shaped nozzle for delivering a shroud of pressurized air about a paint spray issuing from the spray nozzle.

3. A spray guard as recited in claim 2, further comprising:

(a) a fine paint spray fitting to be threaded into said funnel shaped nozzle in front of the spray nozzle, said fitting having a tapered front end portion; and (b) said funnel shaped nozzle having a second series of small holes spaced within inner surface of said funnel shaped nozzle for delivering the shroud of pressurized air inwardly about a fine paint spray issuing from said tapered front end portion of said fitting.

4. A spray guard as recited in claim 3, further comprising a regular paint spray fitting to be threaded into said funnel shaped nozzle in front of the spray nozzle, said fitting having an annular flange to fit contour of said inner surface of said funnel shaped nozzle to block said second series of small holes.

* * * * *